US008529192B2

(12) United States Patent
Beers et al.

(10) Patent No.: US 8,529,192 B2
(45) Date of Patent: Sep. 10, 2013

(54) THRUST BEARING SHAFT FOR THRUST AND JOURNAL AIR BEARING COOLING IN A COMPRESSOR

(75) Inventors: Craig M. Beers, Wethersfield, CT (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 573 days.

(21) Appl. No.: 12/882,273

(22) Filed: Sep. 15, 2010

(65) Prior Publication Data

US 2012/0064815 A1 Mar. 15, 2012

(51) Int. Cl.
*F15D 1/00* (2006.01)

(52) U.S. Cl.
USPC ..... 415/107; 415/229

(58) Field of Classification Search
USPC ..... 415/104, 105, 106, 229, 216.1, 93, 415/96; 384/107, 121; 29/889.2, 898.04, 29/898.07
See application file for complete search history.

(56) References Cited

U.S. PATENT DOCUMENTS 4,896,975 A 1/1990 Bescoby et al.
5,073,037 A * 12/1991 Fujikawa et al. ..... 384/120
6,212,935 B1 4/2001 Shiozaki et al.
6,249,366 B1 6/2001 Hinton et al.
6,328,475 B1 12/2001 Jager
6,450,781 B1 9/2002 Petrovich et al.
6,455,964 B1 9/2002 Nims
6,664,686 B2 12/2003 Ichiyama
7,342,332 B2 3/2008 McAuliffe et al.
7,394,175 B2 7/2008 McAuliffe et al.
7,648,279 B2 1/2010 Struziak et al.
7,648,280 B2 1/2010 Struziak et al.

* cited by examiner

*Primary Examiner* — Edward Look
*Assistant Examiner* — Maxime Adjagbe
(74) *Attorney, Agent, or Firm* — Carlston, Gaskey & Olds, PC

(57) ABSTRACT

A thrust bearing shaft has an enlarged disk at one axial end to provide a rotating surface in a thrust bearing. A first cylindrical portion extends from the disk. A second cylindrical portion has a smaller diameter than the first cylindrical portion and extends from the first cylindrical portion to an end of the thrust shaft remote from the disk. The thrust shaft has a hollow bore with a ledge extending across the bore at a location within the first cylindrical portion. The ledge is formed with a central hole of a first hole diameter, and twelve air holes spaced circumferentially about the central hole. The twelve holes are formed of a second hole diameter, with a ratio of the first hole diameter to the second hole diameter being between 2.55 and 2.71. In addition, a bearing assembly, a compressor, and a method of assembling a compressor are disclosed.

16 Claims, 2 Drawing Sheets

THRUST BEARING SHAFT FOR THRUST AND JOURNAL AIR BEARING COOLING IN A COMPRESSOR

BACKGROUND

This application relates to a thrust bearing shaft incorporated into a compressor for use in supplying cabin air in an aircraft.

Compressors are known and include a motor driven to rotate a shaft and in turn drive a compressor rotor. Typically, there are bearings incorporated into a housing which support the shaft for rotation. One known type of bearing is an air bearing.

In one known air bearing, cooling air is brought into a bearing cooling inlet. The cooling air passes along thrust bearing surfaces, and then may pass between the shaft and various housing portions. The thrust bearing surfaces are spaced from a disk which rotates with a thrust shaft. The thrust shaft rotates with the motor rotor, and the compressor rotor.

The thrust bearing surfaces include a pair of surfaces on axial sides of the disk. Air passes along both of those surfaces. Air on one side of the disk passes along an outer periphery of the thrust shaft, and air on an opposed side of the disk will pass into a bore within the thrust shaft. This air passes through a plurality of holes formed in an internal ledge in the thrust shaft. A portion of this air can then pass radially outwardly through holes in a cylindrical portion of the shaft, while a separate portion continues along the bore of the thrust shaft. In the past, there has been insufficient cross-sectional flow area in the ledge to ensure adequate air flow.

SUMMARY

A thrust bearing shaft has an enlarged disk at one axial end to provide a rotating surface in a thrust bearing. A first cylindrical portion extends from the disk. A second cylindrical portion has a smaller diameter than the first cylindrical portion and extends from the first cylindrical portion to an end of the thrust shaft remote from the disk. The thrust shaft has a hollow bore with a ledge extending across the bore at a location within the first cylindrical portion. The ledge is formed with a central hole of a first hole diameter, and twelve air holes spaced circumferentially about the central hole. The twelve holes are formed of a second hole diameter, with a ratio of the first hole diameter to the second hole diameter being between 2.55 and 2.71.

In addition, a bearing assembly, a compressor, and a method of assembling a compressor are disclosed and claimed.

These and other features of the present invention can be best understood from the following specification and drawings, the following of which is a brief description.

DETAILED DESCRIPTION

Figures 1A, 1B:
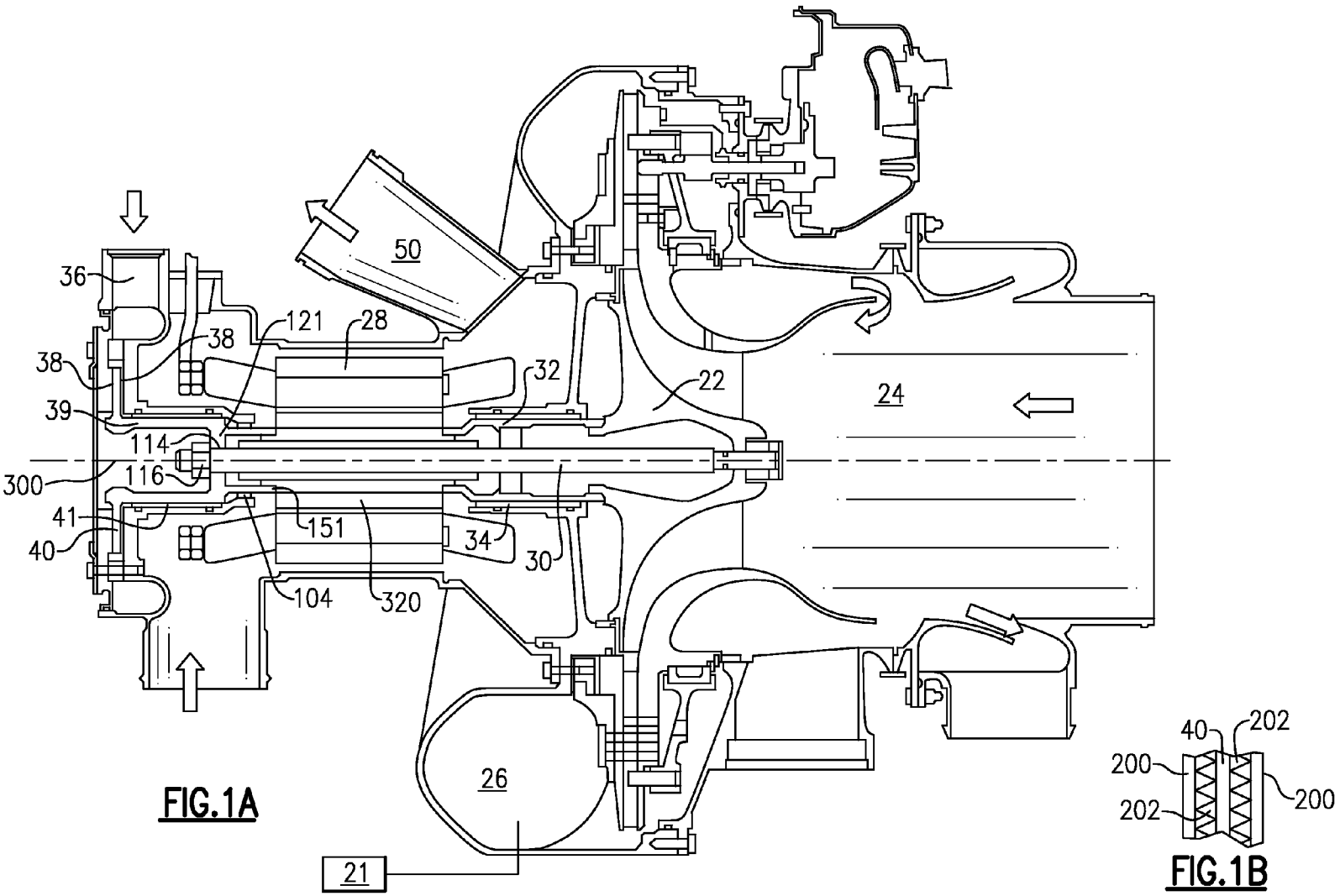
FIG. 1A is a cross-sectional view of a compressor incorporated into a cabin air supply.
FIG. 1B shows a detail of the thrust bearings.

As shown in FIG. 1A, a compressor 20 may be incorporated into a cabin air supply system 21 for passing air across the cabin of an aircraft. A rotor 22 receives air to be compressed from an inlet 24, and passes it to a compressor outlet 26. A motor 28 drives a tie rod, or driveshaft 30, to rotate the rotor 22.

An air bearing shaft 32 is positioned radially inward of journal bearings 34. Air passes into a cooling inlet 36, and between thrust bearing surfaces 38 and a thrust bearing disk 40 which is associated with a thrust shaft 39. A portion of the air passes along the thrust bearing surfaces 38, and then between the outer periphery of the thrust shaft 39 and journal bearings 41. That air passes further downstream, and across the bearings 34. Eventually, this air passes outwardly of outlet 50.

As shown in FIG. 1B, the thrust bearing surfaces 38 of FIG. 1A are defined between two housings 200, and a plurality of corrugated bearing members 202. Air passages are defined between the thrust bearing disk 40 and the corrugations 202. In addition, further air passages are defined between the corrugations 202 and the housings 200.

Air passes through the air passages, with a portion on a rear side of the disk 40 passing into an interior bore 300 of the thrust shaft 39. Another portion passes over the journal bearings 41. The shaft 30 has a nut 116 which extends through a hole 114 in a central ledge 121 in the thrust shaft 39.

Flow passages within the thrust shaft 39 will be explained with reference to FIGS. 2-4.

Figure 2:
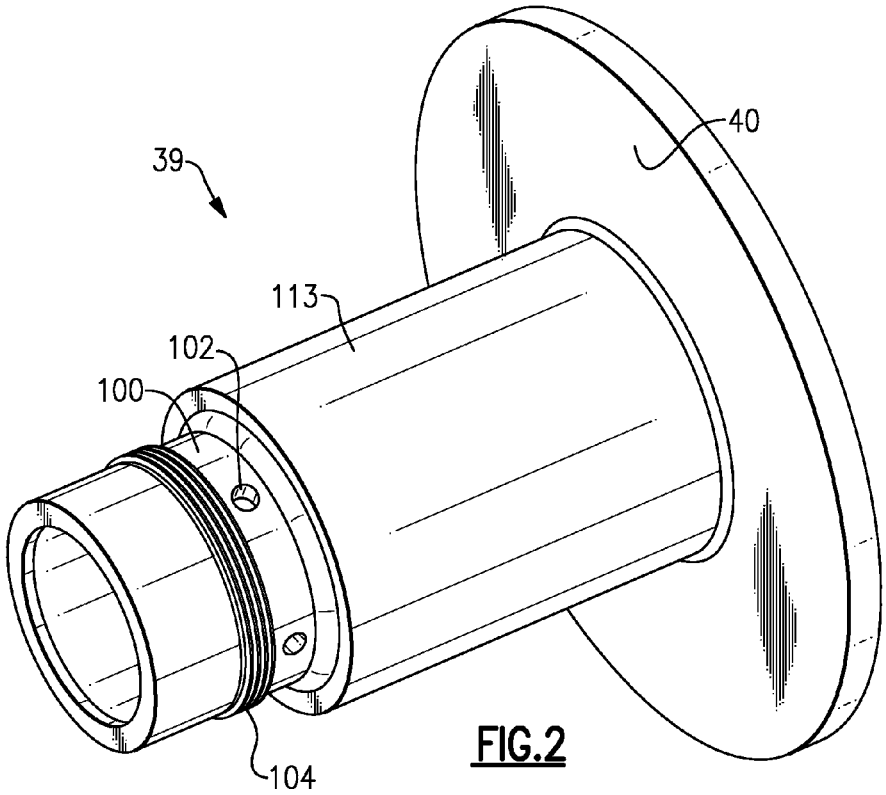
FIG. 2 is a perspective view of a thrust shaft.

FIG. 2 shows the thrust shaft 39 having the disk 40, a first cylindrical portion 113, a smaller second cylindrical portion 100 having a plurality of radially extending holes 102, and seal members 104.

Figure 3:
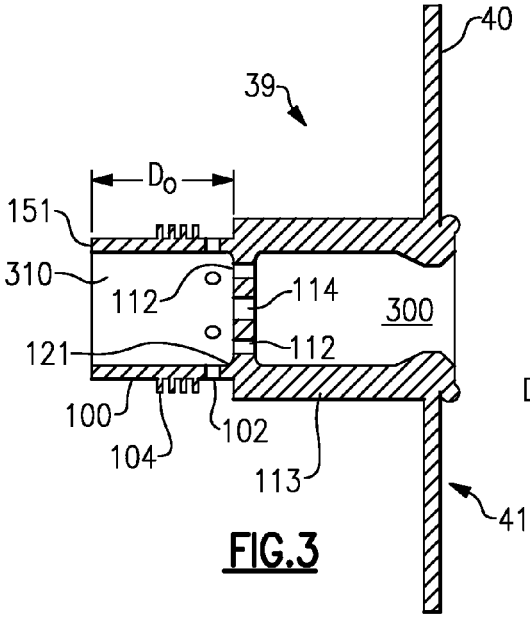
FIG. 3 is a cross-sectional view through the FIG. 2 shaft.

As shown in FIG. 3, the ledge 121 has a plurality of air holes 112, and a central bolt hole 114. The relative sizes of the holes in FIG. 3 are not to scale. A distance $D_0$ from an end 151 of second cylinder portion 100 to the beginning of the ledge 121 was 1.165" (2.96 cm) in one embodiment.

Figure 4:
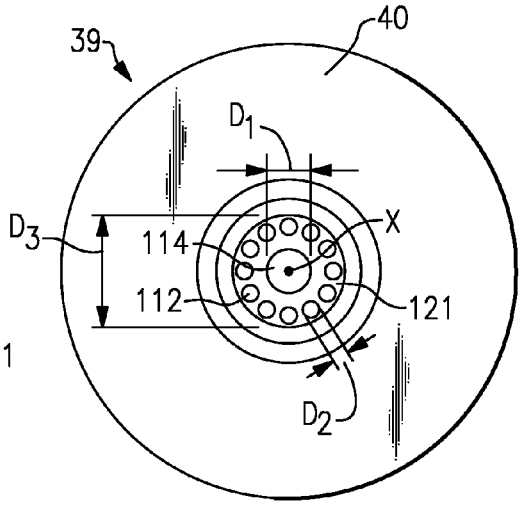
FIG. 4 is an end view of the FIG. 2 shaft.

As shown in FIG. 4, the diameter $D_1$ of the central bolt hole 114 was 0.495" (1.257 cm) in this embodiment. In this embodiment, the diameter of the axial air holes 112, $D_2$, was 0.188" (0.478 cm). A diameter $D_3$ to the inner periphery of the second cylindrical portion 100 was 1.1981 (3.04 cm) in one embodiment.

The holes 112 are all equally spaced about an axial centerline X, and thus by 30°. In embodiments, a ratio of $D_1$ to $D_2$ was between 2.55 and 2.71. In embodiments, a ratio of $D_3$ to $D_2$ was between 6.20 and 6.55.

As can be appreciated, the air that passes into the interior bore 300 of the thrust shaft 39 can pass through the holes 112, and into a space 310 within the second cylindrical portion 100. A portion of this air can pass radially outwardly through holes 102, while another portion extends forwardly toward a motor rotor 320. The increased volume of air flow passages provided by the holes 112 ensure the adequate flow of this air.

As can be appreciated, there are six holes 102, and twelve air holes 112. In the prior art, there were equal number of air holes in the ledge as the holes 102. In this embodiment, the air holes 102 have a diameter of 0.150" (0.381 cm), and thus are smaller than the air holes 112.

In a method of assembling the compressor, the thrust shaft 39 is attached to the motor rotor 320 by initially having the motor rotor 320 placed in liquid nitrogen to reduce its size. Then, the end 151 of the thrust shaft is mounted on a surface on the motor rotor 320. At the same time, the air bearing shaft 32 is connected to an opposed end of the motor rotor 320, and an opposed end of the air bearing shaft 32 is secured to the compressor rotor 22. Then, the tie shaft 30 is positioned through the rotor 22, the shaft 32, the rotor 320, and the shaft 39. The nut 116 is then tightened on the tie shaft 30 to secure all of the components together. The assembled construction can then be placed within the housing, with the housing portions 200 and corrugations 202 spaced from the disk 40.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A thrust shaft comprising:

a shaft body having an enlarged disk at one axial end to provide a rotating surface in a thrust bearing;

a first cylindrical portion extending from said disk, and a second cylindrical portion having a smaller diameter than said first cylindrical portion, said second cylindrical portion extending from said first cylindrical portion to an end of said shaft remote from said disk; and said shaft body having a hollow bore, with a ledge extending across said hollow bore at a location within said first cylindrical portion, and said ledge being formed with a central hole of a first hole diameter, and twelve holes spaced circumferentially about said central hole, said twelve holes being formed of a second hole diameter, with a ratio of said first hole diameter to said second hole diameter being between 2.55 and 2.71.

2. The shaft as set forth in claim 1, wherein a bore diameter to an inner bore of said second cylindrical portion is defined, and a ratio of said bore diameter to said second hole diameter is between 0.411 and 0.415.

3. The shaft as set forth in claim 1, wherein a second group of holes is formed in the outer periphery of said second cylindrical portion, wherein the number of holes in said second group of holes is less than 12.

4. The shaft as set forth in claim 3, wherein a hole diameter of said second group of holes is smaller than said second hole diameter.

5. A thrust bearing assembly comprising:

a pair of thrust bearing members to be positioned on opposed sides of a disk on a thrust shaft body; and said thrust shaft body having an enlarged disk at one axial end to be positioned between said thrust bearing members, a first cylindrical portion extending from said disk, and a second cylindrical portion having a smaller diameter than said first cylindrical portion, said second cylindrical portion extending from said first cylindrical portion to an end of said shaft remote from said disk, said thrust shaft body having a hollow bore, with a ledge extending across said hollow bore at a location within said first cylindrical portion, and said ledge being formed with a central hole of a first hole diameter, and twelve holes spaced circumferentially about said central hole, said twelve holes being formed of a second hole diameter, with a ratio of said first hole diameter to said second hole diameter being between 2.55 and 2.71.

6. The assembly as set forth in claim 5, wherein a bore diameter to an inner bore of said second cylindrical portion is defined, and a ratio of said bore diameter to said second hole diameter is between 0.411 and 0.415.

7. The assembly as set forth in claim 5, wherein said thrust bearing members are defined by corrugations which provide air passages.

8. The assembly as set forth in claim 5, wherein a second group of holes is formed in the outer periphery of said second cylindrical portion, wherein the number of holes in said second group of holes is less than 12.

9. The assembly as set forth in claim 8, wherein a hole diameter of said second group of holes is smaller than said second hole diameter.

10. A cabin air compressor for use in an aircraft comprising:

a motor driving a main shaft, said main shaft driving a compressor rotor;

a housing enclosing said motor, said main shaft and said compressor rotor, and said housing including two opposed housing portions each providing air thrust bearing surfaces; and a thrust shaft body having an enlarged disk at one end positioned between said opposed housing portions to define thrust bearing surfaces, a first cylindrical portion extending from said disk, and a second cylindrical portion having a smaller diameter than said first cylindrical portion, said second cylindrical portion extending from said first cylindrical portion to an end of said shaft remote from said disk, said thrust shaft body having a hollow bore, with a ledge extending across said hollow bore at a location within said first cylindrical portion, and said ledge being formed with a central hole of a first hole diameter, and twelve holes spaced circumferentially about said central hole, said twelve holes being formed of a second hole diameter, with a ratio of said first hole diameter to said second hole diameter being between 2.55 and 2.71, and said main shaft extending through said central hole to secure said thrust shaft body to rotate with said compressor rotor.

11. The compressor as set forth in claim 10, wherein a bore diameter to an inner bore of said second cylindrical portion is defined, and a ratio of said bore diameter to said second hole diameter is between 0.411 and 0.415.

12. The compressor as set forth in claim 10, wherein said thrust bearing members are defined by corrugations which provide air passages.

13. The compressor as set forth in claim 10, wherein a second group of holes is formed in the outer periphery of said second cylindrical portion, wherein the number of holes in said second group of holes is less than 12.

14. The compressor as set forth in claim 13, wherein a hole diameter of said second group of holes is smaller than said second hole diameter.

15. The compressor as set forth in claim 10, wherein said second cylindrical portion has an end remote from said ledge which is secured on a rotor for said motor, and said main shaft extending through said central hole, and securing said thrust shaft, said motor rotor and said compressor rotor together to rotate together.

16. A method of assembling a compressor comprising the steps of:

(a) providing a thrust shaft body having an enlarged disk at one axial end to provide a rotating surface in a thrust bearing, a first cylindrical portion extending from said disk, and a second cylindrical portion having a smaller diameter than said first cylindrical portion, said second cylindrical portion extending from said first cylindrical portion to an end of said shaft remote from said disk, and said shaft having a hollow bore, with a ledge extending across said hollow bore at a location within said first cylindrical portion, and said ledge being formed with a central hole of a first hole diameter, and twelve holes spaced circumferentially about said central hole, said twelve holes being formed of a second hole diameter, with a ratio of said first hole diameter to said second hole diameter being between 2.55 and 2.71;

(b) securing said thrust shaft body to rotate with a motor rotor and a compressor rotor, and positioning said thrust bearing shaft disk to be intermediate two housing portions, with said two housing portions each defining thrust bearing surfaces in combination with said disk; and (c) extending a main shaft through said central hole and securing a nut on said main shaft to secure said main shaft, said thrust shaft body, said motor rotor and said compressor rotor to rotate together.

* * * * *